United States Patent [19]

Seidler

[11] Patent Number: 4,627,943

[45] Date of Patent: Dec. 9, 1986

[54] PROCESS FOR THE PRODUCTION OF SPHERICAL METALLIC PARTICLES

[76] Inventor: Wolfgang Seidler, Gartenweg 5, 4600 Dortmund 50, Fed. Rep. of Germany

[21] Appl. No.: 680,400

[22] Filed: Dec. 11, 1984

[30] Foreign Application Priority Data

Dec. 20, 1983 [DE] Fed. Rep. of Germany ..... 3345983

[51] Int. Cl.[4] ..... B29B 9/10

[52] U.S. Cl. ..... 264/14; 264/13; 264/15; 264/24

[58] Field of Search ..... 264/15, 13, 14, 22, 264/24, DIG. 51

[56] References Cited

U.S. PATENT DOCUMENTS

| | | | |
|---|---|---|---|
| 2,186,659 | 1/1940 | Vogt | 264/15 |
| 2,586,818 | 2/1952 | Harnns | 264/DIG. 51 |
| 2,947,115 | 8/1960 | Wood | 425/7 |
| 3,036,338 | 5/1962 | Nack | 264/DIG. 51 |
| 3,615,187 | 10/1971 | Suzukawa et al. | 264/15 |
| 3,856,441 | 12/1974 | Suzukawa et al. | 425/7 |
| 3,877,960 | 4/1975 | Knoss | 264/15 |
| 3,947,165 | 3/1976 | Szatkowski | 264/24 |
| 4,104,342 | 8/1978 | Wessel et al. | 264/12 |
| 4,246,208 | 1/1981 | Dundas | 264/14 |
| 4,476,071 | 10/1984 | Borer et al. | 264/15 |

*Primary Examiner*—Donald Czaja
*Assistant Examiner*—Mary Lynn Fertig
*Attorney, Agent, or Firm*—Toren, McGeady, Stanger, Goldberg & Kiel

[57] ABSTRACT

A process is disclosed for producing spherical metallic particles which are especially suited for use as an abrasive wherein a particulate metal starting material is liquified by counter-current flow with a hot gas stream which places the solid and liquid particles in a fluidized state and the liquified particles are droplets upon reaching a sufficiently small size are carried upwardly out of the fluidized zone and then cooled to form the spherical particles. An apparatus for carrying out the process is also disclosed.

16 Claims, 1 Drawing Figure

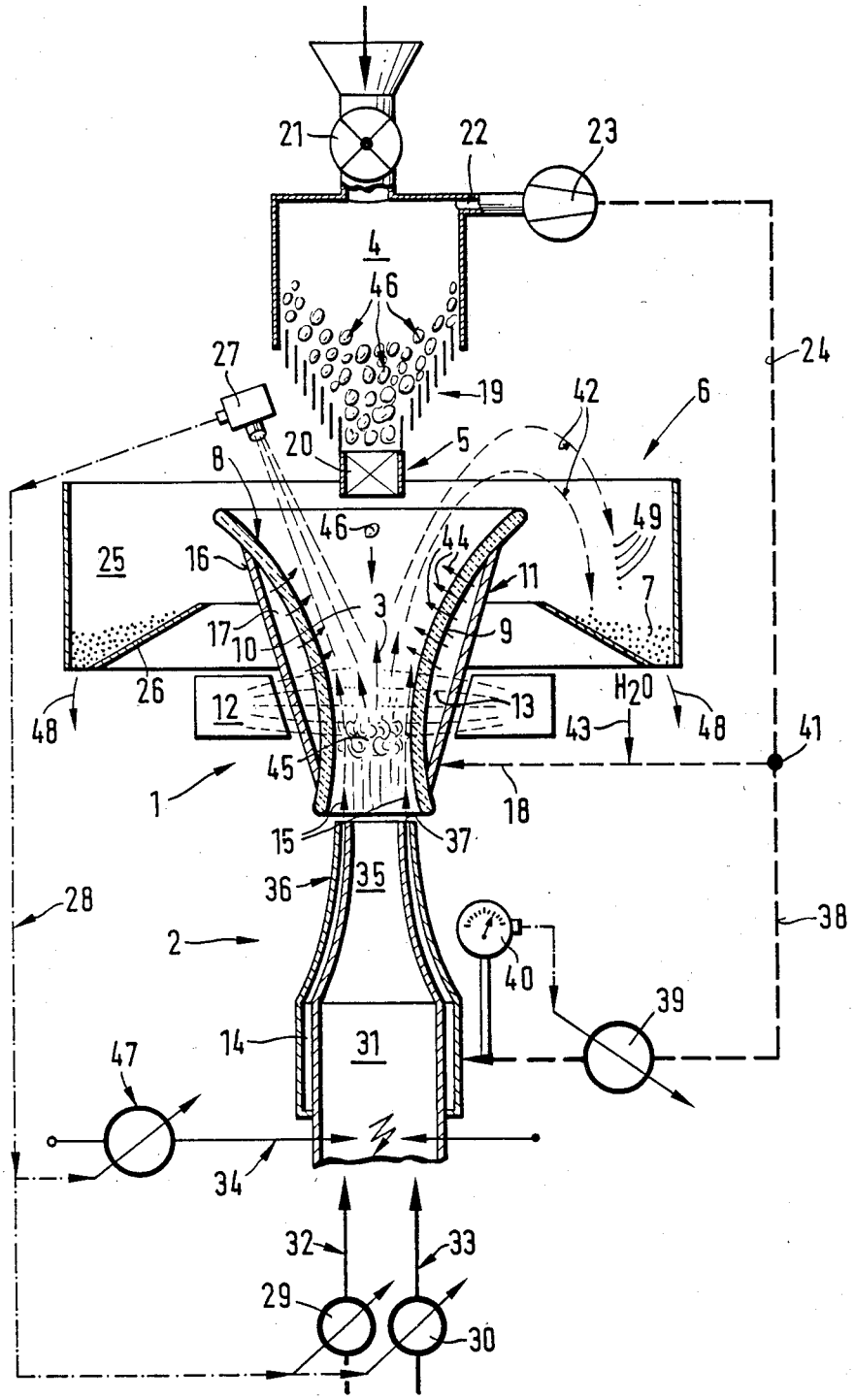
21
22
23
4
46
24
27
19
42
6
20
5
8
49
46
44
25
16
11
7
3
17
10
9
26
12
13
H2O
48
43
48
41
45
1
18
15
37
36
35
28
38
2
40
39
14
31
47
34
32
33
29
30

PROCESS FOR THE PRODUCTION OF SPHERICAL METALLIC PARTICLES

BACKGROUND OF THE INVENTION

1. Field of the Invention

The invention is for a process and a device for the production of spherical metallic particles.

2. Description of the Prior Art

It is known that metallic particles, especially those for use as an abrasive or blasting material, can be produced by dispersing molten iron into a transversely directed stream of water. The tear-shaped formations that are produced through this process solidify in a water bath or in the water vapor created during the process. These processes produce non-spherical particles. Often, the particles resemble an elongated teardrop with a tail. Such abrasives have poor pouring and flow properties as compared to spherical particles, and produce worse results in the use as an abrasive. Also, non-spherical abrasive particles suffer greater wear which produces relatively more dust and particles that solidify in a water bath often show cracks.

Another disadvantage of the known method is the need for a melting oven which limits the process to the environs of a metal mill or a foundry for efficiency.

SUMMARY OF THE INVENTION

The present invention provides a process and a device for producing spherical metal particles especially suitable for use as an abrasive. The process and device is uncomplicated, economically efficient, and produces abrasive particles that are spherical with no cracks and of high uniformity. The process can be carried out away from a metal mill or a foundry and within a small space. Furthermore, the inventive apparatus requires relatively low investment costs and is economically efficient, i.e., with substantial recovery of heat.

More particularly, this is achieved according to the process of the invention by charging a metered amount of metal parts, such as, scrap metal and metal chips, into an upwardly flowing high energy stream of hot gas. This suspends the metal chips in a fluidized state, in which they become molten particles, which are also fluidized.

With this process, it is possible in a surprisingly simple and economical manner to produce in a continuous process, just the amount of molten material as is needed to produce the abrasive particles. For economic efficiency, it is important that use can be made of inexpensive scrap metal and metal chips as starting materials.

A further development of the process provides that after the metal parts are melted, they are dispersed within the gas stream into little droplets, and are carried out of the fluidized layer and the gas stream by virtue of the gas' sweeping forces.

The melting process and the droplet dispersion are in a state of equilibrium. Advantageously, as soon as the metal melt is heated to a certain low viscosity, the energy level and turbulence of the hot gas stream cause immediate dispersion of the melt into small droplets. The gas stream in turn has a sizing function in that only those droplets are carried out that are small enough in relation to the sweeping forces. This attains a surprising uniformity of the particles through the kinetic system of the gas stream.

The process further provides that in order to solidify the droplets, they are preferably carried in a slow manner into cooler steam or gas layers, and therefore develop free of cracks and are collected after solidification. The droplets are then carried out of the fluidized layer by the gas stream according to a ballistic flight path and solidify preferably at the highest point into the ideal spherical form. This avoids the acceleration forces that occur with the known process.

BRIEF DESCRIPTION OF THE DRAWING

The drawing is a cross-sectional view of an apparatus in accordance with the present invention.

DESCRIPTION OF THE PREFERRED EMBODIMENT

The production of a uniform fluidizing bed is enhanced by using, as the starting materials, metal chips or finely shredded scrap and precipitated particles which can be pressed into tablet-like forms. This achieves the advantage of using raw materials of approximately the same size and weight of a German one-pfennig coin (16 mm). Such tablet-like pellets are known for their respective behavior in gas streams and can easily be produced in a small molding press.

To produce the hot gas stream, a burner charged with a burnable gas and oxygen as well as a plasma torch can be used.

The plasma torch is especially advantageous since its flame is very hot and its gas stream especially fast.

Furthermore, it is provided that a reducing atmosphere is achieved within the hot gas stream. This proves advantageous to avoid marginal decarbonization of the particles.

To achieve a stable equilibrium of forces in the fluidizing bed, the hot gas stream passes from below upwardly through a funnel-shaped flow channel which is preferably partially developed as a fluidized bed oven.

The enlargement of the diameter provides an advantageous distribution of the flow speed in relation to the diameter, especially in the upper part. Also, contact of the liquid particles with the walls is avoided. Nevertheless, deflection of the liquid particles in an outward direction is achieved which facilitates an automatic discharge.

The flow development is enhanced by using a flow channel fashioned after a Venturi valve which carries the hot gas stream.

When charging the apparatus or device with the particulate starting material, the inherent kinetic energy of the particles resulting from the free fall, has to be neutralized. In accordance with another embodiment of the invention, a magnetic field is applied from outside in the area above the fluidized bed zone. This slows down the free fall velocity of the ferromagnetic particles, and prevents the particles from falling through the flow channel. The magnetic field makes use of the insight that a particle loses its ferromagnetic property before it reaches its melting temperature. Therefore, the magnetic field does not effect a deceleration during discharge of the melted particle.

A further feature of the process provides that the hot gas stream is surrounded by a cooling gas envelope. With this, the kinetic energy of the gas envelope could, at a minimum, be as great as the kinetic energy of the hot gas stream. On the other hand, it can be advantageous that the kinetic energy of the gas envelope is greater than the kinetic energy of the hot gas stream. In the latter case, the flow of the gas envelope effects the dispersion of the melt into droplets and the discharge of the droplets, while the hot gas stream essentially provides the thermic energy of the melting process. It also provides that this process is economically efficient, especially where the temperature of the gas envelope is significantly lower than the temperature of the hot gas stream.

A further advantageous feature of the process provides that to obtain a predetermined average arithmetic grain size of the particles, the temperature of the hot gas stream is controlled.

The effect is that while, constantly charging the hot gas stream with raw material, the temperature of the hot gas stream can be regulated according to the resulting arithmethic average grain size of the particles.

Furthermore, in order to influence the spherical shape of the particles, one or more of the following parameters can be set:

1. supply to the envelope gas
2. temperature of the envelope gas
3. energy, i.e., kinetic content of the envelope gas
4. energy of the magnetic field.

A further advantageous development of the inventive process provides that the collected particles may be separated by screening. The waste grains in the end product can then be recovered and recycled to the raw starting material. Although the fraction of waste pellets is small, mixing it with the raw materials improves the press molding process.

Economic efficiency is achieved by making use of the primary energy in such a way that waste heat of the hot gas stream is used to preheat the raw material. This is made possible by using the process in a continuous fashion.

The waste heat of the hot gas stream could also be used to heat the gas envelope, or otherwise the exhaust of the fluidizing bed oven can be reused as the envelope gas.

Referring to the drawing, shown is a fluidizing chamber 1 with an oven wall 8 defining a flow channel 10. This oven wall 8 comprises a flow conducting body 9 having a steadily increasing diameter in an upward direction resulting in a funnel-like structure. Below the flow channel 10 is a device 2 for the production of hot gas. In the diagram, this is a plasma burner 31 which is equipped with a feeder 32 and a feeder 33 for plasma gas.

Furthermore, there is a lead 34 for the electric energy, e.g., for the production of an electric arc. The plasma burner has a jet nozzle 35 in the form of an acceleration jet. Around this jet nozzle 35 there is a jet 36 with a ring-like exit channel 37. The jet 36 serves as a feeder of the envelope gas 15 and is connected to the ring channel 14. To this channel 14, the envelope gas is fed through lead 38 and a control unit 39. The control unit is adjusted by the pressure sensor 40 in a pressure-dependent fashion.

The plasma burner 31 produces a hot gas stream 3 which flows through the flow channel 70 with a relatively high kinetic and thermic energy.

Above the fluidizing bed oven 1 is located a charging container 4. Charging container 4 has a metering discharge unit 5 with a discharge unit 20, for example a dosage groove. The charging container 4 is equipped with a gas-permeable bottom 19 and closes on top with an input lock 21. This input lock 21 is connected with a pressurized gas lead 24 which branches at point 41 into lead 18 and lead 38 for the cooling gas and the envelope gas.

To collect the end product pellets 7 which are discharged from the fluidizing bed oven 1 in a parabola path 42, a collecting container 25 is attached to the bottom of the fluidizing bed oven in ring form. The bottom of the collecting container slopes conically towards the outside edge.

The oven wall 8 consists preferably of a porous, high temperature resistant sintered material. The oven wall 8 is surrounded by a double wall 16 which, together with the oven wall 8, encloses a space 17 for a cooling agent. Through lead 18 a gaseous coolant or cooling agent is fed into the space 17. For conditioning of the coolant, a water jet 43 can be used.

The cooperative effect of the porous oven wall 8 and the cooling agent is that the cooling agent, after cooling off the oven wall 8, can escape perhaps through the oven wall 8 according to arrows 44 and thereby provides a further insulating coolant layer between the hot gas stream 3 and the oven wall 8.

In the area of or closely above of the fluidizing bed 45, a magnet system 12 is arranged on the outside 11 of fluidizing bed oven 1. The magnetic system is arranged so that its magnetic field 13 (shown through the fine broken lines) extends through flow channel 10 at its narrowest area above the fluidizing bed 45. This magnetic field 13 has the effect of of slowing down the particles 46 of the raw materials falling from the charging container 4 so that they lose their gravitational energy before they enter the fluidizing bed 45. If the magnetic system 12 is arranged lower, it is possible that a slowing down and arresting of the travel of the falling particles 46 in the fluidizing bed 45 is achieved, until the particles are liquified.

To control the arithmetic average of the pellet size of the end product 7, it is required that the temperature of the fluidizing bed 45 is set. As an example for a possible arrangement of measurement and regulation devices, the diagram shows a radiation pyrometer 27. The pyrometer 27 measures the temperature of the fluidizing bed 45 and converts the measurement into an electric signal. This signal is relayed through the signal lead 28 to the control unit 29 in feeder 32 and to control unit 30 in feeder 33 for plasma gas.

An additional control unit 47 for electric energy can likewise be regulated directly or through a converter or relay (not shown) through signal lead 28.

The operation of the shown apparatus or device to the extent not mentioned already is as follows:

To initiate the apparatus, the plasma burner 31 is fired, thereby producing a hot gas stream which intersperses the flow channel 10 of the fluidizing bed oven with a gas stream 3. This gas stream is rich in kinetic and thermal energy.

The gas suction unit 23 is activated. This gas suction unit takes up the hot gas from the fluidizing bed oven 1 which rises through the gas-permeable bottom 19 and forces it through lead 24 as well as through the branch lead 38 into the ring channel 14 of jet 36. When the pressures created by the gas suction unit 23 are sufficiently high, the envelope gas 15 emerges from the ring channel 14 through the exit channel 37 of jet 36 with velocities considerably higher than those of the hot gas.

The particles 46, stored in the charging container, are carried by metering discharge 5 which is operated by discharge control unit 20 in the direction of arrow A, through the hot gas stream 3, first into the area of magnetic field 13 where their velocity is slowed down. Sinking further down into the fluidized bed 45, the particles 46 collect within the fluidized bed 45. Within the fluidized bed, a stable equilibrium is maintained between the gravitational forces of the incoming particles 46 and the upward flow of hot gas stream 3 and envelope gas 15.

The considerably higher velocity of the envelope gas 15, in comparison to plasma gas, causes the particles 46 to orient themselves toward the middle of stabilized fluidized bed 45. There they are melted within the shortest time by the plasma and form a fluidized bed melt in the area of the fluidized bed. The melt consists of single droplets 49. When these single droplets 49 have taken up sufficient kinetic energy after attaining a small enough diameter, they are discharged from the fluidizing bed oven 1 in a parabolic path 42, where they solidify at about the zenith of the parabolic path 42. This leads to the formation of an ideal spherical form. These spheres are collected in a collecting apparatus 6 as end product 7 and can be withdrawn in the direction of arrows 48.

By providing the charging container 4 with a gas-permeable bottom 19 and connecting it to the gas exhaust unit 23, hot exhaust gas is sucked from the fluidizing bed oven into the charging container 4. This results in preheating of particles 46 and a lower net energy consumption. A similarly advantageous effect is attained when the still warm exhaust is removed from charging container 4 into lead 24 and branch lead 38 and re-introduced into the cycle as envelope gas 15.

Since the kinetic energy of envelope gas 15 influences the uniform arithmetic average pellet size of the particles 49, the pressure of the envelope gas is held constant in front of jet 37 with a pressure sensor 40 and the control unit 37 which is regulated by the sensor 40.

To keep the temperature of the melt in the fluidized bed 45 at a constant level, a radiation pyrometer 27 is provided which constantly measures the temperature and which converts the measurements into electrical control signals, and influences, through signal lead 28 or a regulator of conventional design (not shown), the control units 47 for supplying electric energy and 29 or 30 for supplying the gases.

In addition, cooling the oven wall 8 provides resistance to the high temperature.

Consequently, the invention provides an efficient production of spherical metallic particles never attained before, by using the most modern technology which yields a superior quality product while using only a small amount of energy.

What is claimed is:

1. In a process for the production of spherical metal particles for use as an abrasive wherein a particulate metal starting material is liquified and formed into molten droplets which are solidified by contact with a cooling gas, the improvement which comprises: passing the particulate starting material downwardly into an upward flowing stream of hot gas surrounded by a cooling envelope gas stream, the flow rate of the hot gas stream being sufficient to place the particles in a fluidized state creating a fluidized bed zone to which a magnetic field is applied and the temperature of the hot gas being sufficient to melt the particles.

2. The process of claim 1 wherein the metal particles are melted within the hot gas stream and then dispersed into droplets by the upward force of the gas stream and are carried out of the fluidized bed by the upward sweeping force of the gas stream.

3. The process of claim 1 or 2 wherein the droplets are carried upwardly into cooler gas layers in which they solidify and are then collected after solidification.

4. The process of claim 3 wherein the particles solidify slowly.

5. The process of claim 1 or 2 wherein the metal particles are composed of metal chips or finely shredded waste pellets which are press molded into tablet-shaped particles.

6. The process of claim 1 or 2 wherein the hot gas stream is produced by a burner using a burnable gas and oxygen or a plasma burner.

7. The process of claim 1 or 2 wherein a reducing atmosphere is present within the hot gas stream.

8. The process of claim 1 or 2 wherein the hot gas stream is introduced from below into a funnel-shaped chamber so that the gas stream develops into a gradually enlarging flow channel which forms with the pellets and the chamber a fluidized bed oven.

9. The process of claim 1 or 2 wherein the hot gas stream is fed upwardly by a Venturi jet.

10. The process of claim 1 or 2 wherein the kinetic energy of the envelope gas is at least equal to that of the hot gas stream and the temperature of the envelope gas is substantially lower than that of the hot gas stream.

11. The process of claim 1 or 2 wherein the yield and arithmetic average pellet size of the spherical metal particles is controlled by the temperature of the hot gas stream.

12. The process of claim 1 or 2 wherein the spherical shape of the metal particles is determined by controlling the amount of envelope gas supplied, the temperature of the envelope gas, the kinetic energy of the envelope gas, or the energy of the magnetic field.

13. The process of claim 1 or 2 wherein the product particles are screened to separate waste pellets therefrom and the separated waste pellets are recycled and added to the starting material.

14. The process of claim 1 or 2 wherein the heat from the hot gas stream is used to preheat the starting materials.

15. The process of claim 1 or 2 wherein the heat from the hot gas stream is used to heat the envelope gas.

16. The process of claim 1 or 2 wherein the hot gases escaping from the fluidized bed are collected and recycled as the envelope gas.

* * * * *